US011214747B2

(12) United States Patent
Rhee et al.

(10) Patent No.: US 11,214,747 B2
(45) Date of Patent: Jan. 4, 2022

(54) MULTI-FUNCTIONAL FOAM CONCENTRATE-TYPE AGENT FOR INHIBITING SPONTANEOUS IGNITION OF SOFT COAL

(71) Applicants: Qhwanghee Rhee, Seoul (KR); MISAN E&C, Seoul (KR)

(72) Inventors: Qhwanghee Rhee, Seoul (KR); Jaehyeon Koo, Daejeon (KR); Hongchul Jun, Seoul (KR); Seong Mun, Yongin-si (KR); Seonggi O, Seoul (KR)

(73) Assignees: Qhwanghee Rhee, Seoul (KR); MISAN E&C, Seoul (KR)

( * ) Notice: Subject to any disclaimer, the term of this patent is extended or adjusted under 35 U.S.C. 154(b) by 0 days.

(21) Appl. No.: 17/051,501

(22) PCT Filed: Jan. 10, 2020

(86) PCT No.: PCT/KR2020/000539
§ 371 (c)(1),
(2) Date: Oct. 29, 2020

(87) PCT Pub. No.: WO2020/149584
PCT Pub. Date: Jul. 23, 2020

(65) Prior Publication Data

US 2021/0214631 A1 Jul. 15, 2021

(30) Foreign Application Priority Data

Jan. 16, 2019 (KR) ..... 10-2019-0005826

(51) Int. Cl.

| | |
|---|---|
| ***C10L 5/32*** | (2006.01) |
| ***A62C 3/06*** | (2006.01) |
| ***C10L 9/10*** | (2006.01) |
| ***C10L 10/02*** | (2006.01) |

(52) U.S. Cl.
CPC ..... *C10L 5/32* (2013.01); *A62C 3/06* (2013.01); *C10L 9/10* (2013.01); *C10L 10/02* (2013.01); *C10L 2230/081* (2013.01)

(58) Field of Classification Search
CPC .... C10L 5/32; C10L 9/10; C10L 10/02; C10L 2230/081; A62C 3/06
See application file for complete search history.

(56) References Cited

U.S. PATENT DOCUMENTS 4,551,261 A 11/1985 Salihar
5,876,622 A * 3/1999 Pullen ..... B01D 21/26 252/88.1

FOREIGN PATENT DOCUMENTS

| | | | |
|---|---|---|---|
| KR | 10-1047515 | B1 | 7/2011 |
| KR | 10-1316422 | B1 | 10/2013 |
| KR | 10-2017-0035423 | A | 3/2017 |
| KR | 10-2018-0012296 | A | 2/2018 |
| KR | 10-2019-0002338 | A | 1/2019 |

* cited by examiner

*Primary Examiner* — Cephia D Toomer
(74) *Attorney, Agent, or Firm* — KORUS Patent, LLC; Seong Il Jeong

(57) ABSTRACT

The present invention relates to a multifunctional spontaneous combustion inhibitor for bituminous coal in the form of a foam concentrate, which may inhibit the spontaneous combustion of bituminous coal, prevent the scattering of bituminous coal, prevent the occurrence of problems due to spontaneous combustion, such as a power plant operation failure, bituminous coal waste, and odor generation, enables a bituminous coal power plant to be operated economically, safely and environmentally friendlily through the use of inexpensive bituminous coal, and may be used even at −20° C. by improving the pour point thereof. The present invention is characterized in that a spontaneous combustion inhibitor is prepared in the form of a water-soluble foam concentrate by using an antioxidant, a volatile fraction activation inhibitor, and an emulsifier compound, is mixed with water and air, and is distributed and applied to bituminous coal in a foamed state.

3 Claims, No Drawings

MULTI-FUNCTIONAL FOAM CONCENTRATE-TYPE AGENT FOR INHIBITING SPONTANEOUS IGNITION OF SOFT COAL

TECHNICAL FIELD

The present invention relates to a spontaneous combustion inhibitor for bituminous coal, which may prevent the occurrence of problems due to spontaneous combustion, such as power plant operation failure, bituminous coal waste and odor generation, and more particularly to a multifunctional foam concentrate-type spontaneous combustion inhibitor for bituminous coal, which is prepared in the form of a water-soluble foam concentrate by a method of adding a surfactant during the preparation of a spontaneous combustion inhibitor rather than a method of adding the surfactant after the preparation of the spontaneous combustion inhibitor, which prevents the spontaneous combustion of bituminous coal by being evenly distributed and applied to the bituminous coal in a foamed state when the spontaneous combustion inhibitor prepared in the form of a water-soluble foam concentrate is mixed with water and sprayed onto the bituminous coal, and which is also is helpful to prevent the scattering of bituminous coal in an indoor coal storage yard.

BACKGROUND ART

In general, the spontaneous combustion of coal occurs due to the combined action of various factors such as volatile matter, water, the degree of carbonization, oxidation by impurities, and oxygen absorption.

When coal absorbs oxygen from air or water, volatile matter contained in the coal is activated due to its low flash point, and at the same time, heat is generated and spontaneous combustion of the coal occurs. As the size of coal particles decreases, the surface area thereof increases and the contact surface thereof with oxygen increases, and thus the spontaneous combustion of the coal particles occurs frequently. Accordingly, the oxidation rate of the coal particles increases, and thus, the incidence of spontaneous combustion increases.

As the storage period of coal increases, the oxygen absorption rate of the coal increases and at the same time, volatile matter having a low flash point is activated, and thus the internal temperature of the coal pile increases and the possibility of spontaneous combustion increases. Therefore, the first important factor is to inhibit the activation of the low-flash-point volatile matter contained in coal during coal storage.

In addition, since bituminous coal that is purchased by power plants and steel mills is mined and transported from the mine, it has a variety of forms, including powder and lumps. Thus, in order to effectively apply a spontaneous combustion inhibitor to coal, the spontaneous combustion inhibitor should be sprayed from top to bottom at the place where coal is dropped in a conveyor belt system, so that it can be applied evenly to the coal. Therefore, the second important factor is to prepare a spontaneous combustion inhibitor in the form of a foam concentrate, which may be sprayed in a foamed state after being mixed with water and air.

In particular, volatile matter content and spontaneous combustion are directly proportional to each other. Accordingly, bituminous coal having a high volatile matter content has a high possibility of spontaneous combustion, and thus is classified as low-grade coal and traded at a low price.

Since bituminous coals have a volatile matter content of 10 to 20%, most of them have the potential for spontaneous combustion. Low-grade coal is inexpensive, but has a high volatile content of 30 to 40%, which increases the risk of spontaneous combustion.

Therefore, if spontaneous combustion can be inhibited by inhibiting the activation of the volatile matter and blocking the absorption of oxygen, a cost-effective energy source can be efficiently ensured by importing inexpensive bituminous coal.

In addition, fires caused by spontaneous combustion in coal yards are often accompanied by explosions, and thus spontaneous combustion inhibitory technology of preventing such fires is technology that is essential in terms of operation of coal-fired power plants.

In recent years, the project of constructing indoor coal storage yards within bituminous coal power plants has been carried out as a part of the government's countermeasures against fine dust. Therefore, the prevention of fires caused by spontaneous combustion in the indoor coal storage yard has become a very important issue in terms of fire prevention in the national infrastructures.

Regarding the cause of spontaneous combustion, the risk of spontaneous combustion increases with increasing oxygen concentration, temperature and humidity as external conditions, and the risk of spontaneous combustion increases with increasing amounts of volatile matter and powdered coal as component conditions.

Looking at cases of accidents caused by spontaneous combustion, in Samcheok, on Dec. 10, 2015, a fire occurred in the process of transferring coal to a conveyor belt and the power plant was shut down. In Dangjin, in August 2011 and November 2018, spontaneous combustion in the coal yard continued for about a week or more, causing the residents to suffer great inconvenience due to odor. In Pocheon, on Aug. 8, 2018, an explosion accident occurred at a thermal power plant due to spontaneous combustion, resulting in personal injury.

Korean Patent No. 10-1047515, which is a patent document described below, describes a low-grade-coal reforming method and a low-grade coal reforming apparatus for improving the quality of low-grade coal and inhibiting spontaneous combustion.

The method for improving the quality of low-grade coal according to the conventional art includes a crushing and sorting step, a dehydration step, a volatile matter removal step, a coating step, an evaporation removal step and a molding step.

The crushing and sorting step is a step of crushing low-grade coal into small pieces. That is, since low-grade coal contains fixed carbon, ash and water, this step is performed to separate fixed carbon from ash and water by crushing the low-grade coal. In the crushing and sorting step, an attrition mill is used to crush low-grade coal.

As described above, it can be seen that the conventional art relates to a low-grade-coal reforming method and a low-grade-coal reforming device, and is composed of an expensive, complex process including a crushing device, a dehydration device, a separation device, a drying device, a coating device, etc., in order to inhibit spontaneous combustion by reforming low-grade coal.

The conventional art which is implemented as described above has a problem in that the process of inhibiting spontaneous combustion by reforming coal is complicated, resulting in increases in the equipment cost and maintenance cost. In particular, the conventional art has a problem in that a separate facility installation space also needs to be prepared.

Meanwhile, as another recent countermeasure against spontaneous combustion, an antioxidant-based spontaneous combustion inhibitor in the foam of a non-foaming concentrate was developed, and a method of mixing the spontaneous combustion inhibitor with a surfactant (anti-scattering agent) and water and applying the mixture to coal is known. However, this method has disadvantages in that the spontaneous combustion inhibitor can cause equipment corrosion, has a high pour point (0° C.), and is inconvenient because it needs to be used simultaneously with the surfactant, and the increased use of chemicals leads to reduction in equipment-related economy.

Therefore, there is an increasing demand for a spontaneous combustion inhibitor that can solve the problems of methods or products that have been attempted to prevent spontaneous combustion in the past.

(Patent Document 1) Patent Document: Korean Patent No. 10-1047515 (registered on Jul. 1, 2011)

DISCLOSURE

Technical Problem

The present invention has been conceived to overcome the above-described conventional problems, and an object of the present invention is to provide a multifunctional spontaneous combustion inhibitor for bituminous coal in the form of a foam concentrate, which is prepared in the form of a foam concentrate by a method of adding a surfactant during preparation of the spontaneous combustion inhibitor rather than a method of adding the surfactant after preparation of the spontaneous combustion inhibitor, and which may be evenly distributed and applied to bituminous coal in a foamed state when the spontaneous combustion inhibitor prepared in the form of a foam concentrate is mixed with water and sprayed onto the bituminous coal, thereby preventing spontaneous combustion and while inhibiting the spontaneous combustion of the bituminous coal preventing the scattering thereof.

Another object of the present invention is to provide a multifunctional spontaneous combustion inhibitor for bituminous coal in the form of a foam concentrate, which may inhibit the spontaneous combustion of bituminous coal, thereby preventing the occurrence of problems due to spontaneous combustion, such as power plant operation failure, bituminous coal waste and odor generation.

Another object of the present invention is to provide a multifunctional spontaneous combustion inhibitor for bituminous coal in the form of a foam concentrate, which may prevent the scattering of bituminous coal while inhibiting spontaneous combustion thereof, thereby enabling a bituminous coal power plant to be operated economically, safely and environmentally friendlily through the use of inexpensive bituminous coal.

Another object of the present invention is to provide a multifunctional spontaneous combustion inhibitor for bituminous coal in the form of a foam concentrate, which may inhibit the spontaneous combustion of bituminous coal in a simple and economical manner.

Another object of the present invention is to provide a multifunctional spontaneous combustion inhibitor for bituminous coal in the form of a foam concentrate, which has an improved pour point so that it may be used even at −20° C.

Technical Solution

To achieve the above objects, a spontaneous combustion inhibitor according to the present invention is prepared in form of a foam concentrate, is sprayed together with water and air, and is distributed and applied to bituminous coal in a foamed state.

In addition, 4 wt % of the spontaneous combustion inhibitor prepared in the form of a foam concentrate is mixed with 96 wt % of air-containing water and is distributed and applied to bituminous coal in a foamed state.

In addition, the spontaneous combustion inhibitor according to the present invention is prepared by mixing 7 to 13 wt % of an antioxidant, 20 to 40 wt % of a volatile matter activation inhibitor, 20 to 40 wt % of an emulsifier compound, and 20 to 40 wt % of water.

In addition, the antioxidant in the spontaneous combustion inhibitor according to the present invention comprises phenylenediamine that prevents the oxidation of bituminous coal.

In addition, the volatile matter activation inhibitor in the spontaneous combustion inhibitor according to the present invention comprises methyldiethanolamine (MDEA) that inhibits the activation of volatile matter.

In addition, the emulsifier compound in the spontaneous combustion inhibitor according to the present invention comprises 25 to 40 wt % of butyl diglycol, 2 to 10 wt % of glycol ether, 3 to 10 wt % of a nonionic surfactant, and 45 to 65 wt % of a castor oil-based emulsifier.

Advantageous Effects

The multifunctional spontaneous combustion inhibitor for bituminous coal in the form of a foam concentrate according to the present invention is prepared in the form of a water-soluble foam concentrate using an antioxidant, a volatile matter activation inhibitor and an emulsifier compound. Thus, the spontaneous combustion inhibitor prepared in the form of a water-soluble foam concentrate without an anti-scattering agent may be mixed with water and air and evenly distributed and applied to bituminous coal in a foamed state in a conveyor belt system, thereby inhibiting the spontaneous combustion of the bituminous coal while preventing the scattering thereof.

In addition, since the spontaneous combustion of bituminous coal may be inhibited by distributing and applying the spontaneous combustion inhibitor to the bituminous coal, it is possible to prevent the occurrence of problems such as power plant operation failure, bituminous coal waste and odor generation, particularly due to spontaneous combustion in indoor coal storage yards.

In addition, since the spontaneous combustion inhibitor may inhibit the spontaneous combustion of bituminous coal and, at the same time, prevent the scattering thereof, it is possible to operate a bituminous coal power plant economically, safely and environmentally friendlily through the use of inexpensive bituminous coal.

In addition, it is possible to prepare a spontaneous combustion inhibitor capable of inhibiting the spontaneous combustion of bituminous coal in a simple and economic manner.

In addition, the pour point of the spontaneous combustion inhibitor is also naturally improved by methyldiethanolamine (MDEA) contained in the spontaneous combustion inhibitor, so that the spontaneous combustion inhibitor may be used even at −20° C. or below. Thus, the ease of use of the spontaneous combustion inhibitor may be improved and at the same time, the necessity of providing a thermal insulation facility to a bituminous coal storage tank in terms of equipment is eliminated.

In addition, since the spontaneous combustion inhibitor contains a sufficient amount of the emulsifier compound, it does not need to contain a separate anti-scattering agent for spraying the spontaneous combustion inhibitor in a foamed state, and thus has an economic effect in terms of equipment and maintenance costs.

MODE FOR INVENTION

A spontaneous combustion inhibitor for bituminous coal in the form of a foam concentrate according to the present invention is characterized in that it is prepared in the form of a foam concentrate, is sprayed together with water and air, and is distributed and applied to bituminous coal in a foamed state.

The foam concentrate refers to a water-soluble functional chemical (product) that generates foam by mixing with water, and the foamed state refers to foam (bubble) that is generated when the spontaneous combustion inhibitor prepared in the form of a water-soluble foam concentrate is mixed with water. The spontaneous combustion inhibitor for bituminous coal according to the present invention should be a product in the form of a water-soluble foam concentrate so that an aqueous solution of the spontaneous combustion inhibitor may be prepared by mixing with water. In this case, the spontaneous combustion inhibitor may be expanded to a volume corresponding to the expansion rate thereof, and thus may be evenly distributed and applied to a large amount of bituminous coal in a foamed state.

In this case, the reason for emphasizing water solubility is that it is important to sufficiently mix the core component of the spontaneous combustion inhibitor with water. That is, the reason is that, when the spontaneous combustion inhibitor is sufficiently mixed with water, it may be evenly distributed and applied to a large amount of bituminous coal, and only in this case, may exhibit its effects.

In the present invention, the reason why the spontaneous combustion inhibitor is prepared in the form of a foam concentrate as described above is to evenly distribute and apply an appropriate concentration (ppm) of the core component of the spontaneous combustion inhibitor to the whole of bituminous coal, if possible. Even if a spontaneous combustion inhibitor has excellent performance, when it is not prepared in the form of a foam concentrate, 4 liters of an aqueous solution of the spontaneous combustion inhibitor cannot be evenly applied to 1,000 kg of bituminous coal. Accordingly, in order to effectively apply the spontaneous combustion inhibitor to a large amount of bituminous coal, it is inevitable to apply the spontaneous combustion inhibitor in a foamed state. To this end, the spontaneous combustion inhibitor is prepared in the form of a foam concentrate that is expanded about 10 times. In this case, according to the present invention, when 4 liters of an aqueous solution of the spontaneous combustion inhibitor is sprayed in a foamed state, the amount of foam generated becomes 40 liters. Thus, 40 liters of the spontaneous combustion inhibitor prepared as foam may be distributed and applied to 1,000 kg of bituminous coal.

Preferably, 4 wt % of the spontaneous combustion inhibitor prepared in the form of a foam concentrate is mixed with 96 wt % of water, and distributed and applied to bituminous coal in a foamed state. If the amount of the spontaneous combustion inhibitor is less than 4 wt %, the spontaneous combustion inhibitory ability of the spontaneous combustion inhibitor will decrease, and if the amount is more than 4 wt %, the quality of the spontaneous combustion inhibitor will be lowered. That is, in a preferred embodiment, 4 wt % of the spontaneous combustion inhibitor is mixed with 96 wt % of water, and the mixture is evenly distributed and applied to bituminous coal in a foamed state by means of three or more foam nozzles in a conveyor belt system.

Here, the spontaneous combustion inhibitor according to the present invention is mixed with water for the purpose of easily generating foam. When the spontaneous combustion inhibitor is mixed with water and air, foam is generated more easily, whereby the spontaneous combustion inhibitor may be evenly distributed and applied to bituminous coal. That is, even when the spontaneous combustion inhibitor is not artificially mixed with air, there is no problem in generating foam, because water is supplied by hydraulic pressure and air is mixed with water within the expansion rate of foam. However, in order to generate and maintain better foam in a better manner, air is preferably mixed with the spontaneous combustion inhibitor through a compressor or the like.

In this case, the mixing ratio between an aqueous solution of the spontaneous combustion inhibitor and air is preferably 1:10. As described above, even when air is not mixed with the spontaneous combustion inhibitor through a compressor, it is possible to spray the spontaneous combustion inhibitor in a foamed form. However, in the present invention, the spontaneous combustion inhibitor is mixed with air so that all bituminous coal introduced into the indoor coal storage yard can be showered with foam, whereby the spontaneous combustion inhibitor can be evenly distributed and applied to the bituminous coal.

As described above, when the spontaneous combustion inhibitor prepared in the form of a foam concentrate is mixed with water and air and evenly distributed and applied to bituminous coal in a foamed state, it prevents the scattering of dust from the bituminous coal and, at the same time, contributes to the prevention of oxidation, the inhibition of activation of volatile matter, the inhibition of dust generation, the inhibition of temperature rise, and prevents humidity from dropping, thereby inhibiting the spontaneous combustion of the bituminous coal before the bituminous coal in the carbon storage yard moves to a combustion chamber.

According to an embodiment of the present invention, the spontaneous combustion inhibitor may be prepared by mixing 7 to 13 wt % of an antioxidant, 20 to 40 wt % of a volatile matter activation inhibitor, 20 to 40 wt % of an emulsifier compound, and 20 to 40 wt % of water.

The antioxidant functions to inhibit bituminous coal from absorbing oxygen from air or water, thereby inhibiting the spontaneous combustion of the bituminous coal. The antioxidant is preferably contained in an amount of 7 to 13 wt % based on the total weight of the spontaneous combustion inhibitor. If the content of the antioxidant is less than 7 wt %, the antioxidant stability of the spontaneous combustion inhibitor may decrease, and if the content of the antioxidant is more than 13 wt %, the quality of the spontaneous combustion inhibitor may be degraded.

The volatile matter activation inhibitor functions to inhibit the activation of volatile matter in bituminous coal, thereby inhibiting the spontaneous combustion of the bituminous coal. The volatile matter activation inhibitor is preferably contained in an amount of 20 to 40 wt % based on the total weight of the spontaneous combustion inhibitor. If the content of the volatile matter activation inhibitor is less than 20 wt %, the spontaneous combustion inhibitory ability of the spontaneous combustion inhibitor may decrease, and if the content of the volatile matter activation inhibitor is more than 40 wt %, the quality of the spontaneous combustion inhibitor may be degraded.

The spontaneous combustion inhibitor for bituminous coal is prepared in the foam of a water-soluble foam concentrate using the antioxidant, the volatile matter activation inhibitor and the emulsifier components as main components. The spontaneous combustion inhibitor prepared in the form of a water-soluble foam concentrate is mixed with water and air without an anti-scattering agent and is evenly distributed and applied to bituminous coal in a foamed state, thereby preventing the spontaneous combustion of the bituminous coal and preventing the scattering thereof.

The emulsifier compound contained in the spontaneous combustion inhibitor functions not only to enhance the emulsifying and dispersing ability of the spontaneous combustion inhibitor, but also to reduce the surface tension of water, so that the spontaneous combustion inhibitor may be distributed and applied to bituminous coal in a foamed state. In addition, the emulsifier compound also functions to prevent the scattering of dust. The emulsifier compound is preferably contained in an amount of 20 to 40 wt % based on the total weight of the spontaneous combustion inhibitor. If the content of the emulsifier compound is less than 20 wt %, the emulsifying and dispersing ability may decrease, and if the content of the emulsifier compound is more than 40 wt %, foam may be excessively generated, and thus the dispersibility and applicability of the spontaneous combustion inhibitor may decrease and the pour point of the spontaneous combustion inhibitor may increase, resulting in a decrease in the ease of use.

In addition, the emulsifier compound contained in the spontaneous combustion inhibitor contains a solvent and a solubilizer, and thus functions to lower the viscosity of spontaneous combustion inhibitor, increase the bonding force between the components of the spontaneous combustion inhibitor, increase the service life of the spontaneous combustion inhibitor, and increase the efficiency of drying (water removal).

The antioxidant contained in the spontaneous combustion inhibitor according to an embodiment of the present invention may comprise phenylenediamine that prevents the oxidation of bituminous coal. In this case, since phenylenediamine, which is used as the antioxidant in the spontaneous combustion inhibitor, is stabilized by resonance, it has very high antioxidant activity and in particular, improves the antioxidant stability of the spontaneous combustion inhibitor. Therefore, the phenylenediamine of the present invention may be advantageously used as an antioxidant compound, which is an additive for delaying the oxidative decomposition of the spontaneous combustion inhibitor and further improving the antioxidant stability thereof.

According to an embodiment of the present invention, the volatile matter activation inhibitor in the spontaneous combustion inhibitor may comprise methyldiethanolamine (MDEA) that inhibits the activation of volatile matter. In this case, methyldiethanolamine that is used as the volatile matter activation inhibitor in the spontaneous combustion inhibitor functions as a base catalyst through a hydration reaction with water. This methyldiethanolamine has strong resistance to deterioration and corrosion, and may be effectively used as a volatile matter activation inhibitor that inhibits the activation of volatile matter having a low flash point, due to the characteristics thereof, such as high boiling point and low vapor pressure. In this case, the pour point of the spontaneous combustion inhibitor is naturally improved as methyldiethanolamine (MDEA) is used as a main raw material, the spontaneous combustion inhibitor may be used even at −20° C. or below. Thus, the ease of use of the spontaneous combustion inhibitor may be improved and at the same time, the necessity of providing a thermal insulation facility to a bituminous coal storage tank in terms of equipment is eliminated.

According to an embodiment of the present invention, the emulsifier compound in the spontaneous combustion inhibitor may comprise 25 to 40 wt % of butyl diglycol, 2 to 10 wt % of glycol ether, 3 to 10 wt % of a nonionic surfactant, and 45 to 65 wt % of a castor oil-based emulsifier.

The butyl diglycol is used as a basic emulsifier because of its excellent emulsifying properties, low volatility and high boiling point. The butyl diglycol is preferably contained in an amount of 25 to 40 wt % based on the total weight of the emulsifier compound. If the content of the butyl diglycol is more than 25 wt %, the emulsifying property of the emulsifier compound may decrease, and if the content of the butyl diglycol is more than 40 wt %, the quality of the emulsifier compound may be degraded.

The glycol ether is effectively used as a solvent for emulsifying the antioxidant that is difficult to emulsify. The glycol ether is preferably contained in an amount of 2 to 10 wt % based on 100 parts by weight of the emulsifier compound. If the content of the glycol ether is less than 2 wt %, the effect of the solvent may decrease, and if the content of the glycol ether is more than 10 wt %, the quality of the emulsifier compound may be degraded.

The nonionic surfactant is used as a surfactant because of its excellent solubility and stability for an alkaline mixture. The nonionic surfactant is contained in an amount of 3 to 10 wt % based on the total weight of the emulsifier compound. If the content of the nonionic surfactant is less than 3 wt %, the solubility and stability of the emulsifier compound may decrease, and if the content of the nonionic surfactant is more than 10 wt %, the quality of the emulsifier compound may be degraded.

The castor oil-based emulsifier has excellent dispersibility and foaming power and is used as a solubilizer and surfactant for complete dissolution of the antioxidant together with the glycol ether. The castor oil-based emulsifier is preferably contained in an amount of 45 to 65 wt % based on the total weight of the emulsifier compound. If the content of the castor oil-based emulsifier is less than 45 wt %, the dispersibility and foaming power of the emulsifier compound may decrease, and if the content of the castor oil-based emulsifier is more than 65 wt %, the quality of the emulsifier compound may be degraded.

<Evaluation of Spontaneous Combustion Inhibitory Ability>

To evaluate the spontaneous combustion inhibitory ability of a spontaneous combustion inhibitor aqueous solution prepared according to the present invention, 1 kg of bituminous coal being actually used was placed in a container, 4 ml of the spontaneous combustion inhibitor aqueous solution was sprayed onto the bituminous coal. Then, the bituminous coal was heated to 100° C., and toxic gases generated by activation of volatile matter were captured and measured.

In addition, for a comparative experiment, 1 kg of bituminous coal was placed in the same container without spraying the spontaneous combustion inhibitor aqueous solution (4 mg) prepared according to the present invention.

Then, the bituminous coal was heated to 100° C., and toxic gases generated by activation of volatile matter were captured and measured.

As a result of the measurement, it was confirmed that the amount of toxic gases generated from the bituminous coal onto which the spontaneous combustion inhibitor aqueous solution of the present invention was sprayed was smaller than the amount of toxic gases generated from the bituminous coal onto which the spontaneous combustion inhibitor aqueous solution was not sprayed. Thereby, it could be seen that the spontaneous combustion inhibitor of the present invention may exhibit excellent spontaneous combustion inhibitory properties by inhibiting the activation of volatile matter at a temperature of 100° C. or below and preventing oxidation.

Therefore, the present invention has an advantage in that, because the spontaneous combustion inhibitor is prepared in the form of a water-soluble foam concentrate using the antioxidant, the volatile matter activation inhibitor and the emulsifier compound, the spontaneous combustion inhibitor prepared in the form of a water-soluble foam concentrate without an anti-scattering agent may be mixed with water and air and evenly distributed and applied to bituminous coal in a foamed state in a conveyor belt system, thereby inhibiting the spontaneous combustion of the bituminous coal while preventing the scattering thereof.

In addition, the present invention has an advantage in that, because spontaneous combination of bituminous coal may be inhibited by distributing and applying an aqueous solution of the spontaneous combustion inhibitor to the bituminous coal, it is possible to prevent the occurrence of problems particularly due to spontaneous combustion, such as power plant operation failure, bituminous coal waste and odor generation.

In addition, the present invention has an advantage in that, since the spontaneous combustion inhibitor may inhibit the spontaneous combustion of bituminous coal and, at the same time, prevent the scattering thereof, it is possible to operate a bituminous coal power plant economically, safely and environmentally friendlily through the use of inexpensive bituminous coal.

In addition, the present invention has an advantage in that it is possible to prepare a spontaneous combustion inhibitor capable of inhibiting the spontaneous combustion of bituminous coal in a simple and economic manner.

In addition, the present invention has an advantage in that, since the pour point of the spontaneous combustion inhibitor is also naturally improved by methyldiethanolamine (MDEA) contained in the spontaneous combustion inhibitor, so that the spontaneous combustion inhibitor may be used even at −20° C. or below, the ease of use of the spontaneous combustion inhibitor may be improved and at the same time, the necessity of providing a thermal insulation facility to a bituminous coal storage tank in tams of equipment is eliminated.

In addition, the present invention has an advantage in that, since the spontaneous combustion inhibitor contains a sufficient amount of the emulsifier compound, it does not need to contain a separate anti-scattering agent for spraying the spontaneous combustion inhibitor in a foamed state, and thus has an economic effect in terms of equipment and maintenance costs.

The invention claimed is:

1. A multifunctional spontaneous combustion inhibitor prepared in a form of a foam concentrate, which is configured such that it is sprayed together with water and air and distributed and applied to bituminous coal in a foamed state, the spontaneous combustion inhibitor being prepared by mixing 7 to 13 wt % of an antioxidant, 20 to 40 wt % of a volatile matter activation inhibitor, 20 to 40 wt % of an emulsifier compound, and 20 to 40 wt % of water, wherein the antioxidant in the spontaneous combustion inhibitor comprises phenylenediamine.

2. A multifunctional spontaneous combustion inhibitor prepared in a form of a foam concentrate, which is configured such that it is sprayed together with water and air and distributed and applied to bituminous coal in a foamed state, the spontaneous combustion inhibitor being prepared by mixing 7 to 13 wt % of an antioxidant, 20 to 40 wt % of a volatile matter activation inhibitor, 20 to 40 wt % of an emulsifier compound, and 20 to 40 wt % of water, wherein the volatile matter activation inhibitor in the spontaneous combustion inhibitor comprises methyldiethanolamine (MDEA).

3. A multifunctional spontaneous combustion inhibitor prepared in a form of a foam concentrate, which is configured such that it is sprayed together with water and air and distributed and applied to bituminous coal in a foamed state, the spontaneous combustion inhibitor being prepared by mixing 7 to 13 wt % of an antioxidant, 20 to 40 wt % of a volatile matter activation inhibitor, 20 to 40 wt % of an emulsifier compound, and 20 to 40 wt % of water, wherein the emulsifier compound in the spontaneous combustion inhibitor comprises 25 to 40 wt % of butyl diglycol, 2 to 10 wt % of glycol ether, 3 to 10 wt % of a nonionic surfactant, and 45 to 65 wt % of a castor oil-based emulsifier.

* * * * *